US011587756B2

(12) United States Patent
Ala-Toppari et al.

(10) Patent No.: US 11,587,756 B2
(45) Date of Patent: Feb. 21, 2023

(54) ELECTRICAL ASSEMBLY COMPRISING BLOWN FUSE INDICATION SYSTEM

(71) Applicant: Hitachi Energy Switzerland AG, Baden (CH)

(72) Inventors: Juhani Ala-Toppari, Vaasa (FI); Mika Norolampi, Vaasa (FI); Markku Launonen, Vaasa (FI); Janne Rissanen, Vaasa (FI)

( * ) Notice: Subject to any disclaimer, the term of this patent is extended or adjusted under 35 U.S.C. 154(b) by 0 days.

(21) Appl. No.: 17/637,176

(22) PCT Filed: Jul. 7, 2020

(86) PCT No.: PCT/EP2020/069079
§ 371 (c)(1),
(2) Date: Feb. 22, 2022

(87) PCT Pub. No.: WO2021/037425
PCT Pub. Date: Mar. 4, 2021

(65) Prior Publication Data

US 2022/0270841 A1 Aug. 25, 2022

(30) Foreign Application Priority Data

Aug. 29, 2019 (EP) ..... 19194279

(51) Int. Cl.
*H01H 85/30* (2006.01)
*H01F 27/40* (2006.01)

(52) U.S. Cl.
CPC ..... *H01H 85/306* (2013.01); *H01F 27/402* (2013.01); *H01F 2027/404* (2013.01)

(58) Field of Classification Search
CPC ..... H01H 85/306; H01F 27/402; H01F 2027/404
See application file for complete search history.

(56) References Cited

U.S. PATENT DOCUMENTS 2,405,929 A * 8/1946 Wald ..... H01H 85/306 337/147
3,876,948 A * 4/1975 Blumenthal ..... H01H 85/306 337/315

(Continued)

FOREIGN PATENT DOCUMENTS

CN 101361148 A 2/2009
CN 101577199 A * 11/2009

(Continued)

OTHER PUBLICATIONS

International Search Report and Written Opinion of the International Searching Authority, PCT/EP2020/069079, dated Aug. 18, 2020, 15 pages.

(Continued)

*Primary Examiner* — Anatoly Vortman
(74) *Attorney, Agent, or Firm* — Sage Patent Group

(57) ABSTRACT

An electrical assembly comprising a housing forming a liquid tank inside thereof, dielectric liquid in the liquid tank, at least one fuse, and a blown fuse indication system. Each of the fuses is immersed in the dielectric liquid, and is provided with a striker pin. The blown fuse indication system is adapted to indicate a blowout of any one of the fuses by an indication signal. The blown fuse indication system comprises a first indication member and a second indication member. The first indication member is movable by the striker pins. The second indication member is immovably connected to the housing, and adapted to generate the indication signal as a response to relative movement between the first indication member and the second indication member.

20 Claims, 4 Drawing Sheets

(56) References Cited

U.S. PATENT DOCUMENTS

| | | | | | |
|---|---|---|---|---|---|
| 5,019,937 | A | | 5/1991 | Beard | |
| 5,367,281 | A | * | 11/1994 | Crooks | H01H 85/303 337/417 |
| 5,633,619 | A | | 5/1997 | Oetjen et al. | |
| 5,786,743 | A | * | 7/1998 | Viscogliosi | H01H 85/306 337/267 |
| 5,880,664 | A | * | 3/1999 | Hollmann | H01H 85/38 337/159 |
| 6,211,768 | B1 | * | 4/2001 | Cress | H01H 85/042 337/171 |
| 7,576,635 | B2 | * | 8/2009 | Bender | H02J 13/0004 340/638 |
| 9,299,522 | B2 | * | 3/2016 | Sudhakar | H02B 11/127 |
| 9,406,475 | B2 | * | 8/2016 | Bruchmann | H01H 9/104 |
| 9,583,297 | B2 | * | 2/2017 | Benke | F16C 1/10 |
| 10,102,995 | B2 | * | 10/2018 | Rosenquist | H01H 85/0241 |
| 2011/0163836 | A1 | | 7/2011 | Darr et al. | |
| 2015/0287564 | A1 | | 10/2015 | Benke et al. | |

FOREIGN PATENT DOCUMENTS

| | | | | | |
|---|---|---|---|---|---|
| CN | 101577199 | A | | 11/2009 | |
| CN | 201655725 | U | * | 11/2010 | |
| CN | 102870185 | A | | 1/2013 | |
| CN | 205406478 | U | | 7/2016 | |
| CN | 207282443 | U | | 4/2018 | |
| DE | 3413219 | A1 | | 10/1984 | |
| JP | S6354234 | U | | 3/1988 | |
| JP | H0547295 | A | | 2/1993 | |
| JP | H06275188 | A | | 9/1994 | |
| KR | 101900012 | B1 | * | 9/2018 | |
| KR | 101900012 | B1 | | 9/2018 | |
| WO | 1996039708 | A1 | | 12/1996 | |
| WO | 1998035419 | A1 | | 8/1998 | |
| WO | WO-2018223321 | A1 | * | 12/2018 | H01H 85/306 |

OTHER PUBLICATIONS

Notice of Grounds of Rejection for Japanese Patent Application No. 2022-513231, dated Aug. 16, 2022, 10 pages.

Notification to Grant Patent Right for Invention for Chinese Application No. 202080060003.8, dated Aug. 1, 2022, 5 pages.

* cited by examiner

ELECTRICAL ASSEMBLY COMPRISING BLOWN FUSE INDICATION SYSTEM

CROSS-REFERENCE TO RELATED APPLICATIONS

This application is a 35 U.S.C. § 371 national stage application of PCT International Application No. PCT/EP2020/069079, filed on Jul. 7, 2020, which in turn claims foreign priority to European Patent Application No. 19194279.6, filed on Aug. 29, 2019, the disclosures and content of which are incorporated by reference herein in their entireties.

TECHNICAL FIELD

The present disclosure relates to an electrical assembly comprising a blown fuse indication system.

BACKGROUND

Blown fuse indication systems are used in transformers and other electrical devices.

Herein, a transformer is a static electrical device comprising a housing and a winding system located inside the housing, the winding system comprising a primary winding and a secondary winding, and the transformer being adapted to transfers electrical energy between the primary winding and the secondary winding without an electrically conductive connection between the primary winding and the secondary winding.

A known transformer comprises fuses immersed in dielectric liquid inside a liquid tank formed by a housing of the transformer, and a blown fuse indication system adapted to indicate a blowout of any one of the fuses by an indication signal. The blown fuse indication system comprises micro switches immersed in the dielectric liquid, and adapted to generate the indication signal, and wires adapted to transfer the indication signal from the micro switches to outside the housing.

One of the problems associated with the above known transformer is that replacing the micro switches is difficult. Further, the wires of the blown fuse indication system create a galvanic contact path close to live components inside the housing.

SUMMARY

An object of the present disclosure is to provide an electrical assembly so as to solve the above problems. The objects are achieved by an electrical assembly which is characterized by what is stated in the independent claim. The preferred embodiments are disclosed in the dependent claims.

The various embodiments described herein are based on the idea of providing an electrical assembly with a blown fuse indication system that is adapted to generate an indication signal as a response to relative movement between a first indication member and a second indication member, wherein the first indication member is adapted to be moved by a striker pin of a fuse through a connection mechanism, and the second indication member is immovably connected to the housing of the electrical assembly.

An advantage of the electrical assembly that may be achieved is that the blown fuse indication system does not require any galvanic contact paths close to live components inside the housing.

BRIEF DESCRIPTION OF THE DRAWINGS

The accompanying drawings, which are included to provide a further understanding of the disclosure and are incorporated in and constitute a part of this application, illustrate certain non-limiting embodiments of inventive concepts. In the drawings.

DETAILED DESCRIPTION

Figure 1:
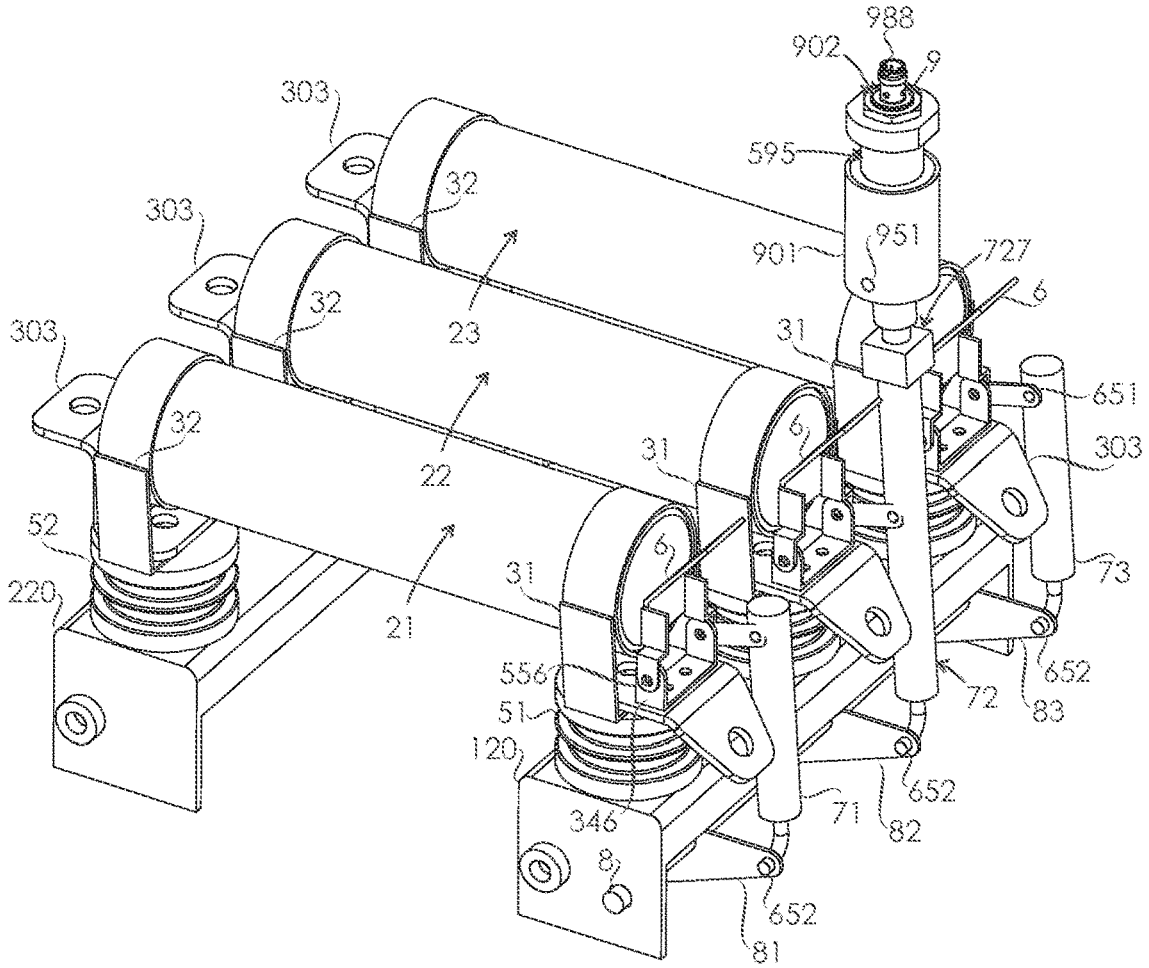
FIG. 1 shows as an axonometric projection of a portion of an electrical assembly according to an embodiment.
Figure 2:
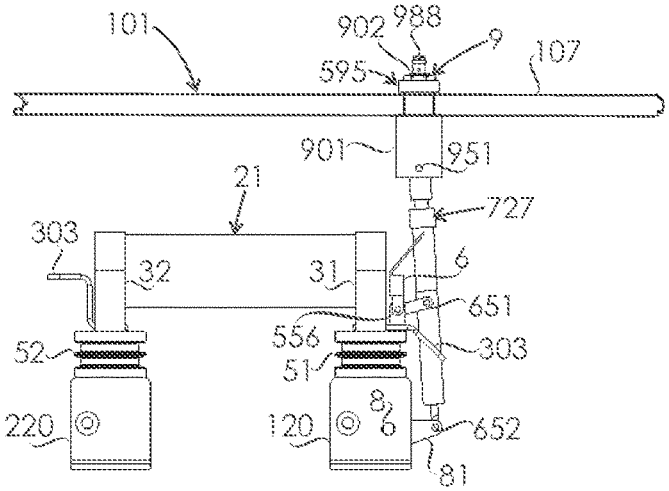
FIG. 2 shows the portion of the electrical assembly of FIG. 1 as seen from a direction parallel to actuator member pivoting axes.
Figure 3:
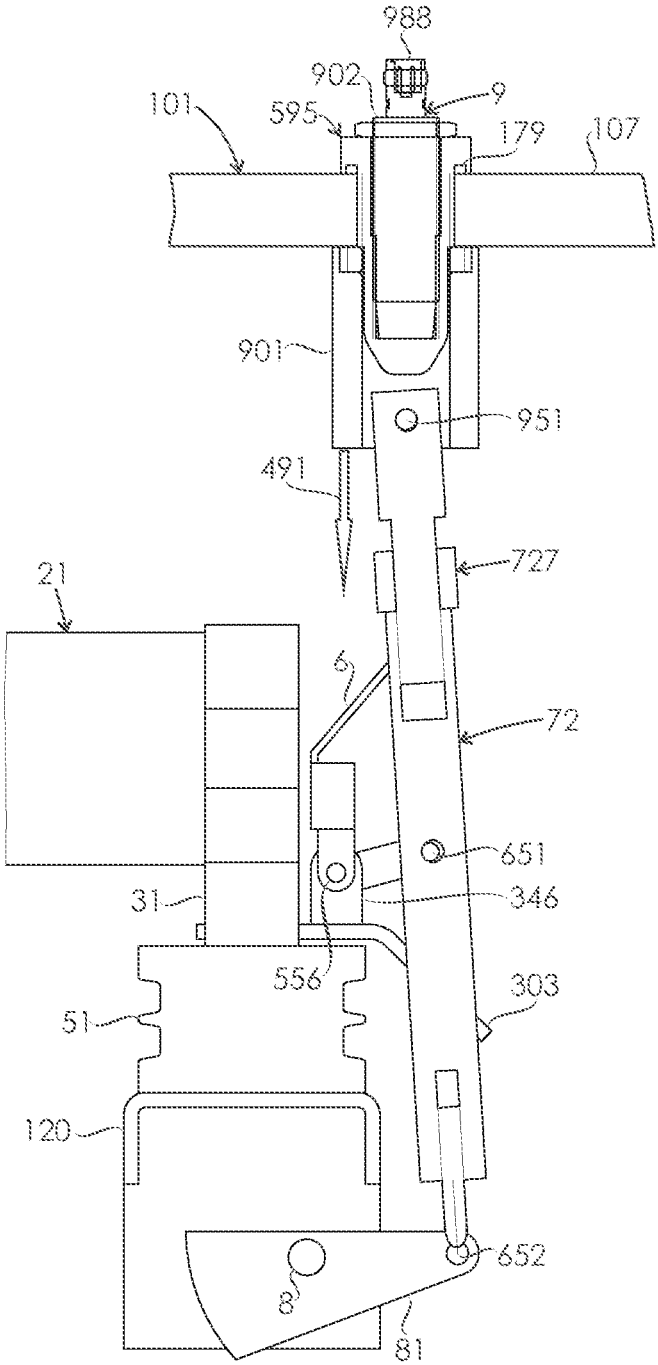
FIG. 3 shows a cross section of a detail of the portion of the electrical assembly of FIG. 2, the electrical assembly being in a first operating state.
Figure 4:
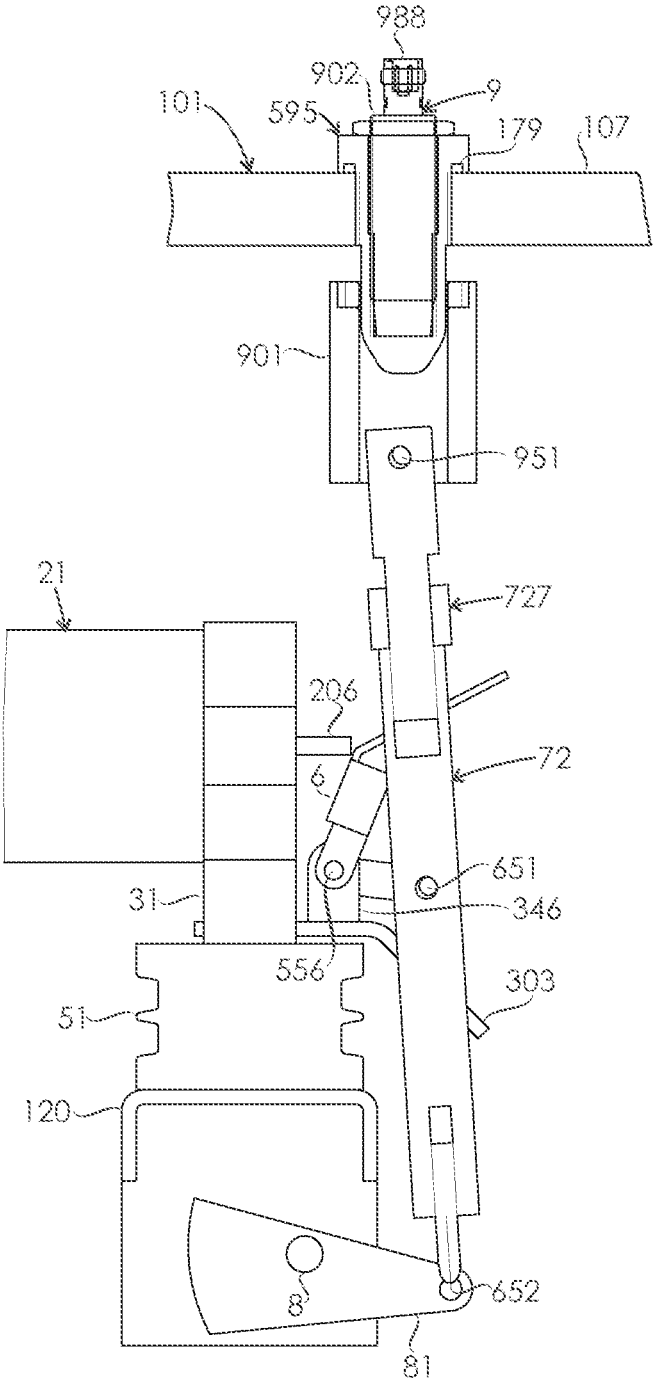
FIG. 4 shows a cross section of a detail of the portion of the electrical assembly of FIG. 2, the electrical assembly being in a second operating state.

FIG. 1 shows a portion of an electrical assembly according to an embodiment. The portion shown in FIG. 1 comprises a fuse system, a supporting structure and a blown fuse indication system. FIG. 2 shows the portion of the electrical assembly of FIG. 1 from a different direction, and additionally shows a piece of a housing 101 of the electrical assembly. FIGS. 3 and 4 show cross sections of a detail of the portion of the electrical assembly of FIG. 2. In FIG. 3, the electrical assembly is in a first operating state in which fuses of the fuse system are in working order. In FIG. 4, the electrical assembly is in a second operating state in which the fuses of the fuse system are blown.

The fuse system comprises three fuses 21, 22 and 23, each one of which is provided with a striker pin 206 shown in the cross section of FIG. 4. The fuses 21 to 23 are electrically insulated from each other. In FIGS. 2 to 4, longitudinal direction of the fuses 21 to 23 is a horizontal direction. The striker pin 206 is adapted to move rectilinearly outwards from an end of corresponding fuse when the fuse blows. Said rectilinear movement of the striker pin 206 is parallel to the longitudinal direction of corresponding fuse.

During operation of the electrical assembly, the fuses 21, 22 and 23 are immersed in dielectric liquid inside a liquid tank formed by the housing 101 of the electrical assembly. Striker pin fuses are known in the art, and they are not discussed in detail herein.

The fuses 21, 22 and 23 of the fuse system are supported to the housing 101 by the supporting structure. The supporting structure comprises a fuse clip system, a fuse base system and an insulator system.

The fuse clip system comprises for each of the fuses 21, 22 and 23 a first fuse clip 31 and a second fuse clip 32. The first fuse clip 31 is electrically conductively connected to a first end of corresponding fuse. The second fuse clip 32 is electrically conductively connected to a second end of corresponding fuse. The fuse clip system further comprises a bus bar 303 for each first fuse clip 31 and second fuse clip 32. Each bus bar 303 is electrically conductively connected to the corresponding fuse clip, and is adapted for connecting a cable to the fuse clip.

The fuse base system comprises a first fuse base 120 and a second fuse base 220 connected to the housing 101.

The insulator system comprises for each of the fuses 21, 22 and 23 a first insulator 51 and a second insulator 52. The first insulator 51 connects the first fuse clip 31 of corresponding fuse to the first fuse base 120, and electrically insulates the first fuse clip 31 from the first fuse base 120. The second insulator 52 connects the second fuse clip 32 of corresponding fuse to the second fuse base 220, and electrically insulates the second fuse clip 32 from the second fuse base 220.

The blown fuse indication system is adapted to indicate a blowout of any one of the fuses 21 to 23 of the fuse system by an indication signal detectable outside the housing 101. The blown fuse indication system comprises an actuator mechanism, a push bar mechanism, a connecting mechanism and a sensor device 9. The actuator mechanism, the push bar mechanism and the connecting mechanism are located inside the housing 101. The blown fuse indication system is best seen in FIGS. 3 and 4.

The actuator mechanism comprises for each of the fuses 21 to 23 an actuator member 6 pivotable around a corresponding actuator member pivoting axis 556 between a normal position and a blown position. The actuator member pivoting axes 556 coincide with each other. Each actuator member 6 is adapted to be pivoted from the normal position to the blown position by the striker pin 206 of corresponding fuse.

Each actuator member 6 is pivotally connected to the corresponding first fuse clip 31. Said pivotal connection is realized by means of a connection piece 346 fixedly connected to the first fuse clip 31, wherein the actuator member pivoting axis 556 passes through the connection piece 346. In an alternative embodiment, each actuator member is pivotally connected to the corresponding first fuse clip such that the actuator member pivoting axis passes through an integral portion of the first fuse clip.

The push bar mechanism comprises for each of the fuses 21 to 23 a push bar connected to the corresponding actuator member 6 such that each push bar is adapted to be moved from a first position to a second position thereof by pivoting of any one of the actuator members 6 from the normal position to the blown position. The push bar corresponding to the fuse 21 is denoted with reference number 71, the push bar corresponding to the fuse 22 is denoted with reference number 72, and the push bar corresponding to the fuse 23 is denoted with reference number 73. The push bar 72 corresponding to the fuse 22 is a sensor push bar.

In FIGS. 1 to 3, the push bars 71 to 73 are in their first position. In FIG. 4, the push bars 71 to 73 are in their second position.

The sensor push bar 72 has a length adjusting mechanism 727 adapted to adjust a distance between the first indication member 901 and a connection point between the sensor push bar 72 and the corresponding actuator member 6. The length adjusting mechanism 727 comprises a first portion of the sensor push bar 72 having an internal thread, and a second portion of the sensor push bar 72 having an external thread such that the internal thread and the external thread are adapted to co-operate with each other for providing the distance adjustment.

The push bar mechanism comprises a first indication member 901 connected to the sensor push bar 72. The first indication member 901 is pivotably connected to the sensor push bar 72 for pivoting around an indication member pivoting axis 951 parallel to the actuator member pivoting axes 556. The first indication member 901 is located inside the housing 101.

The sensor device 9 comprises a second indication member 902 and a signal terminal 988. The second indication member 902 is immovably connected to a wall 107 of the housing 101. The wall 107 is an upper wall of the housing 101. The signal terminal 988 is adapted for supplying the indication signal out of the sensor device 9. The signal terminal 988 is located outside the housing 101.

The second indication member 902 is adapted to generate the indication signal as a response to relative movement between the first indication member 901 and the second indication member 902, provided by the movement of the sensor push bar 72 from the first position to the second position thereof.

The second indication member 902 is adapted to sense when the first indication member 901 is in a position corresponding to the second position of the sensor push 72. In an alternative embodiment, the second indication member is adapted to sense when the first indication member is in an intermediate position corresponding to a position of the sensor push bar between the first and second positions thereof, the intermediate position being selected such that it indicates a situation where the sensor push bar has with certainty left the first position thereof.

The second indication member 902 is an inductive proximity sensor, and immune to magnetic fields. The first indication member 901 comprises aluminium as sensor target for the second indication member 902. Alternatively, the first indication member could comprise iron or other electrically conductive material as sensor target for the inductive proximity sensor.

In alternative embodiments, the second indication member comprises a proximity sensor of another type. A proximity sensor is a sensor able to detect the presence of nearby objects without any physical contact. Different types of proximity sensors require different types of sensor targets.

In an embodiment, the second indication member comprises a capacitive proximity sensor, wherein the first indication member does not have to comprise any electrically conductive material but may be made of plastic, for example. In an alternative embodiment, the second indication member comprises a magnetic proximity sensor, and the first indication member comprises a permanent magnet.

The electrical assembly comprises a separating arrangement forming a liquid tight separation between the second indication member 902 and the liquid tank. The separating arrangement comprises a separating member 595 and a seal member 179. The separating member 595 extends partially between the first indication member 901 and the second indication member 902. The separating member 595 separates the first indication member 901 from the second indication member 902 such that there is no physical contact between them.

The separating member 595 comprises a tubular portion and a flange portion. The flange portion of the separating member 595 is located at a first end of the tubular portion. The tubular portion is blocked at a second end thereof. The separating member 595 is made of electrically insulating material.

The wall 107 of the housing 101 is provided with an indication aperture. The separating member 595 extends through the indication aperture such that the flange portion of the separating member 595 is at a first side of the wall 107, and a part of the tubular portion of the separating member 595 is at a second side of the wall 107. The first side of the wall 107 faces outside the housing 101, and the second side of the wall 107 faces inside the housing 101. The second indication member 902 is partly received in the separating member 595 such that a portion of the second indication member 902 is located at the second side of the wall 107.

The seal member 179 is located between the flange portion of the separating member 595, and the portion of the wall 107 surrounding the indication aperture. The seal member 179 provides a liquid tight seal between the flange portion of the separating member 595 and the wall 107. The seal member 179 is an O-ring.

Due to the liquid tight separation provided by the separating arrangement, the second indication member 902 is adapted to be removed from the rest of the electrical assembly while the indication aperture remains sealed liquid tight. Therefore, the second indication member 902 can be serviced or replaced without opening the liquid tank of the electrical assembly.

The first indication member 901 comprises a cylindrical portion, which in the first position of the sensor push bar 72 surrounds the second indication member 902 in a plane parallel to the wall 107. The separating member 595 is adapted to guide the first indication member 901 during movement of the sensor push bar 72 from the first position to the second position by a contact between an outer surface of the separating member 595 and an inner surface of the cylindrical portion of the first indication member 901.

During the movement of the sensor push bar 72 from the first position to the second position thereof, the first indication member 901 moves away from the wall 107 of the housing 101 in a direction perpendicular to a plane defined by the wall 107. This movement of the first indication member 901 is denoted by an arrow 491 in FIG. 3. In FIGS. 2 to 4 the plane defined by the wall 107 is perpendicular to the image plane.

The connecting mechanism comprises a connecting shaft 8 adapted to rotate around a rotation axis which is parallel to the actuator member pivoting axes 556 and spaced apart from them, and for each of the fuses 21 to 23 a connecting protrusion protruding from the connecting shaft 8 in a direction perpendicular to the rotation axis.

The connecting protrusion corresponding to the fuse 21 is denoted with reference number 81, the connecting protrusion corresponding to the fuse 22 is denoted with reference number 82, and the connecting protrusion corresponding to the fuse 23 is denoted with reference number 83. The connecting shaft 8 is pivotally connected to the first fuse base 120.

The rotation axis of the connecting shaft 8 is parallel to the plane defined by the wall 107. The rotation axis of the connecting shaft 8 is perpendicular to the longitudinal direction of the fuses 21 to 23.

The image plane of FIG. 3 is perpendicular to the indication member pivoting axis 951, the actuator member pivoting axes 556, and the rotation axis of the connecting shaft 8. FIG. 3 shows that the indication member pivoting axis 951, the first pivot joint 651 and the second pivot joint 652 are located on the same line, and the first pivot joint 651 is located between the indication member pivoting axis 951 and the second pivot joint 652.

Each of the push bars 71 to 73 is connected to the corresponding actuator member 6 by a first pivot joint 651, and to the corresponding operating protrusion 81 to 83 by a second pivot joint 652 spaced apart from the first pivot joint 651 and the rotation axis of the connecting shaft 8. The first pivot joint 651 is spaced apart from the actuator member pivoting axis 556.

The push bars 71 to 73 comprise electrically insulating materials such that they electrically insulate the actuator members 6 from the operating protrusions 81 to 83. In alternative embodiments, other components of the blown fuse indication system additionally or alternatively comprise electrically insulating materials for electrically insulating live components of the electrical assembly from each other and the housing of the electrical assembly.

Figure 5:
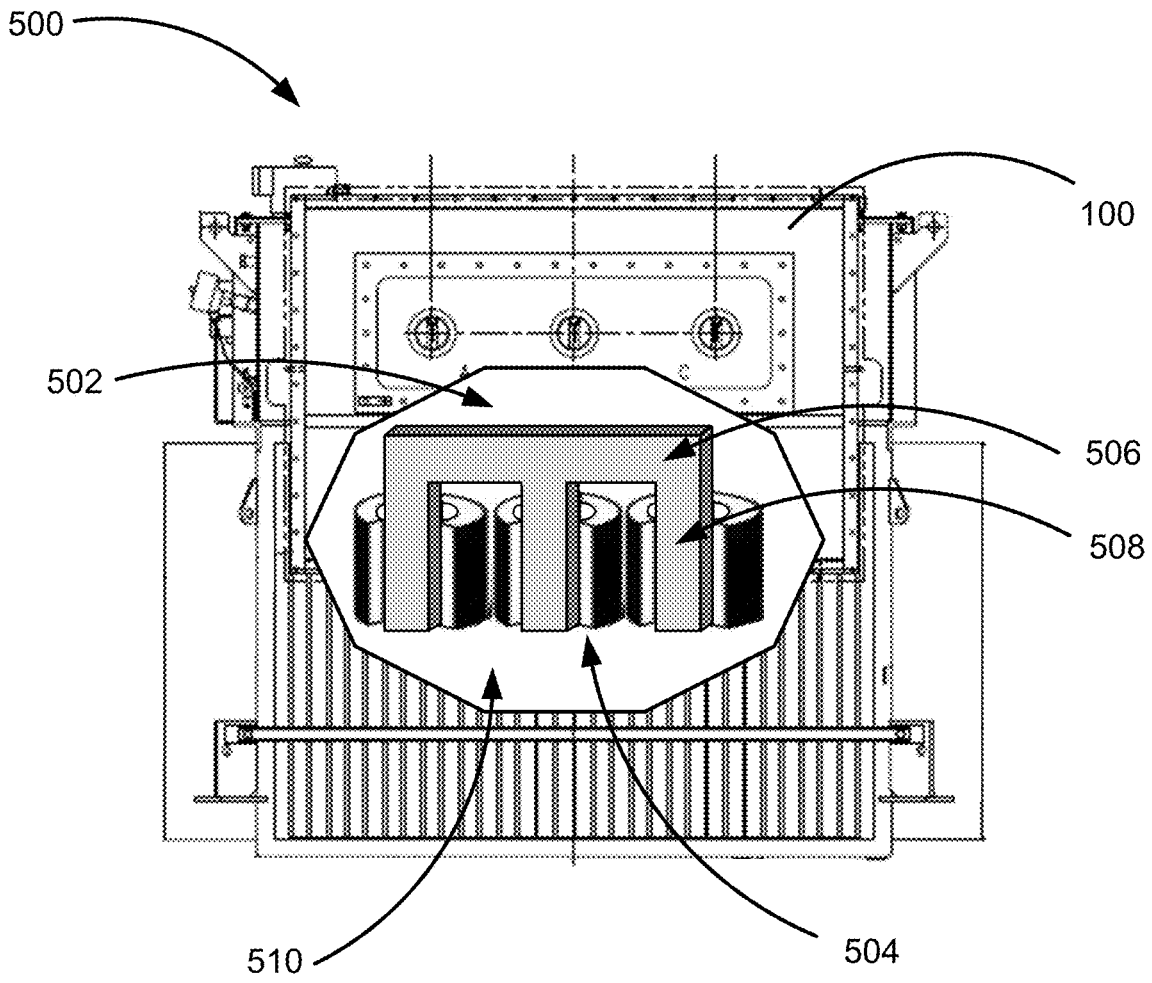
FIG. 5 shows a portion of windings of a medium voltage transformer according to an embodiment.

The electric assembly whose portion is shown in FIG. 1 is a medium voltage transformer. A winding system of the transformer is shown in FIG. 5. The medium voltage transformer 500 has a winding system 502 having windings 504 wound around core 506. The windings 504 are shown as partially cutout so that the legs 508 of the core 506 can be seen. The windings 504 are immersed in dielectric liquid 510.

It will be obvious to a person skilled in the art that the inventive concept can be implemented in various ways. The various embodiments are not limited to the examples described above but may vary within the scope of the claims.

The invention claimed is:

1. An electrical assembly comprising:

a housing forming a liquid tank inside thereof;

a dielectric liquid in the liquid tank;

a fuse system comprising at least one fuse, each fuse provided with a striker pin, immersed in the dielectric liquid, and supported to the housing by a supporting structure;

a blown fuse indication system adapted to indicate a blowout of any one of the at least one fuse by an indication signal detectable outside the housing, wherein the blown fuse indication system comprises:

an actuator mechanism comprising for each of the at least one fuse an actuator member pivotable around a corresponding actuator member pivoting axis between a normal position and a blown position, each actuator member being adapted to be pivoted from the normal position to the blown position by the striker pin of a corresponding fuse, the actuator member pivoting axis being parallel to other actuator member pivoting axes;

a push bar mechanism comprising for each of the at least one fuse a push bar connected to a corresponding actuator member such that each push bar is adapted to be moved from a first position to a second position thereof by pivoting of any one of the actuator members from the normal position to the blown position, wherein one of the push bars is a sensor push bar, and the push bar mechanism comprises a first indication member connected to the sensor push bar;

a sensor device comprising a second indication member and a signal terminal, the second indication member being immovably connected to the housing, and adapted to generate the indication signal as a response to relative movement between the first indication member and the second indication member, and the signal terminal is adapted for supplying the indication signal out of the sensor device, the signal terminal being located outside the housing.

2. An electrical assembly according to claim 1, wherein the first indication member is pivotably connected to the sensor push bar for pivoting around an indication member pivoting axis parallel to the actuator member pivoting axes.

3. An electrical assembly according to claim 1, wherein the second indication member is a proximity sensor, and the first indication member comprises a sensor target for the second indication member.

4. An electrical assembly according to claim 3, wherein the second indication member is an inductive proximity sensor.

5. An electrical assembly according to claim 1, wherein the electrical assembly comprises a separating arrangement forming a liquid tight separation between the second indication member and the liquid tank, the separating arrangement comprising a separating member extending at least partially between the first indication member and the second indication member.

6. An electrical assembly according to claim 5, wherein a wall of the housing is provided with an indication aperture, and the separating member extends through the indication aperture.

7. An electrical assembly according to claim 6, wherein the first indication member comprises a cylindrical portion which in the first position of the sensor push bar surrounds the second indication member in a plane parallel to the wall.

8. An electrical assembly according to claim 1, wherein the sensor push bar has a length adjusting mechanism adapted to adjust a distance between the first indication member and a connection point between the sensor push bar and the corresponding actuator member.

9. An electrical assembly according to claim 8, wherein the length adjusting mechanism comprises a first portion of the sensor push bar having an internal thread, and a second portion of the sensor push bar having an external thread such that the internal thread and the external thread are adapted to co-operate with each other to adjust the distance.

10. An electrical assembly according to claim 1, wherein the electrical assembly comprises a connecting mechanism comprising a connecting shaft adapted to rotate around a rotation axis which is parallel to the actuator member pivoting axes and spaced apart from them, and for each fuse of the at least one fuse a connecting protrusion protruding from the connecting shaft in a direction perpendicular to the rotation axis, and each push bar is connected to the corresponding actuator member by a first pivot joint, and to a corresponding operating protrusion by a second pivot joint spaced apart from the first pivot joint.

11. An electrical assembly according to claim 10, wherein the supporting structure comprises:

a fuse clip system having for each of the at least one fuse a first fuse clip electrically conductively connected to a first end of a corresponding fuse, and a second fuse clip electrically conductively connected to a second end of the corresponding fuse;

a fuse base system having a first fuse base and a second fuse base connected to the housing; and an insulator system having for each of the at least one fuse a first insulator that connects the first fuse clip of corresponding fuse to the first fuse base, and electrically insulates the first fuse clip from the first fuse base, and a second insulator that connects the second fuse clip of corresponding fuse to the second fuse base, and electrically insulates the second fuse clip from the second fuse base, wherein the connecting shaft is pivotally connected to the first fuse base.

12. An electrical assembly according to claim 11, wherein each actuator member is pivotally connected to corresponding first fuse clip.

13. An electrical assembly according to claim 1, wherein the actuator member pivoting axes coincide with each other.

14. An electrical assembly according to claim 1, wherein the electrical assembly is a transformer comprising a winding system immersed in the dielectric liquid.

15. An electrical assembly according to claim 1, wherein the at least one fuse comprises three fuses.

16. A method in an electrical assembly of providing a blown fuse indicator outside of a housing of the electrical assembly, the housing forming a liquid tank inside thereof and having dielectric liquid in the liquid tank, the electrical assembly having a fuse system comprising at least one fuse each provided with a striker pin, immersed in the dielectric liquid, and supported to the housing by a supporting structure, the method comprising responsive to a failure occurring in one of the at least one fuse, enabling the striker pin associated with the failure occurring in one of the at least one fuse to move outwardly to strike an actuator member of an actuator mechanism to pivot from a normal position to a blown position;

responsive to the actuator member pivoting from the normal position to the blown position, enabling a push bar mechanism connected to the actuator member to be moved from a first position to a second position such that each push bar is adapted to be moved from the first position to the second position thereof by pivoting of any one of the actuator members from the normal position to the blown position, wherein one of the push bars is a sensor push bar, and the push bar mechanism comprises a first indication member connected to the sensor push bar;

responsive to the push bar mechanism connected to the actuator member to be moved from the first position to the second position, enabling a second indication member immovably connected to the housing and a part of a sensor device comprising the second indication member and a signal terminal, to generate an indication signal as a response to relative movement between the first indication member and the second indication member, wherein the signal terminal located outside the housing supplies the indication signal out of the sensor device.

17. The method of claim 16, wherein the striker pin moves rectilinearly outwards from an end of a corresponding fuse when the corresponding fuse blows.

18. The method of claim 17, wherein rectilinear movement of the strike pin is parallel to a longitudinal direction of the corresponding fuse.

19. The method of claim 16, wherein to enable the second indication member to generate the indication signal as the response to relative movement between the first indication member and the second indication member an inductive proximity sensor is used to generate the indication signal.

20. The method of claim 16, wherein to enable the second indication member to generate the indication signal as the response to relative movement between the first indication member and the second indication member, a capacitive proximity sensor is used to generate the indication signal.

* * * * *